US010092848B2

(12) United States Patent
Cai

(10) Patent No.: US 10,092,848 B2
(45) Date of Patent: Oct. 9, 2018

(54) FREELY ASSEMBLABLE TOY TRACK

(71) Applicants: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangzhou (CN)

(72) Inventor: Dongqing Cai, Shantou (CN)

(73) Assignees: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangzhou (CN)

( * ) Notice: Subject to any disclaimer, the term of this patent is extended or adjusted under 35 U.S.C. 154(b) by 147 days.

(21) Appl. No.: 15/301,883

(22) PCT Filed: May 13, 2015

(86) PCT No.: PCT/CN2015/078838
§ 371 (c)(1),
(2) Date: Oct. 4, 2016

(87) PCT Pub. No.: WO2015/172716
PCT Pub. Date: Nov. 19, 2015

(65) Prior Publication Data

US 2017/0028305 A1 Feb. 2, 2017

(30) Foreign Application Priority Data

May 14, 2014 (CN) ..... 2014 1 0202455

(51) Int. Cl.
*A63H 18/02* (2006.01)
*A63H 18/04* (2006.01)

(52) U.S. Cl.
CPC ..... *A63H 18/02* (2013.01); *A63H 18/028* (2013.01); *A63H 18/04* (2013.01)

(58) Field of Classification Search
CPC ..... A63H 18/02; A63H 18/028; A63H 19/30; A63H 33/082; A63F 7/3622; A63F 2007/3662
See application file for complete search history.

(56) References Cited

U.S. PATENT DOCUMENTS 3,225,487 A * 12/1965 Mallalieu ..... A63H 18/02 108/110
3,343,793 A * 9/1967 Waser ..... A63F 7/3622 104/134

(Continued)

FOREIGN PATENT DOCUMENTS

CN 1568211 A 1/2005
CN 202460122 10/2012

(Continued)

OTHER PUBLICATIONS

KIPO, Office Action for KR Application No. 20167028268, dated Jan. 25, 2018.

(Continued)

*Primary Examiner* — Zachary L Kuhfuss
(74) *Attorney, Agent, or Firm* — Hodgson Russ LLP

(57) ABSTRACT

A freely assemblable toy track includes a plurality of guide rails and connecting pieces, each guide rail includes two independent strip rails (1) at the left and right, each connecting piece is configured as a frame piece (2) provided with a connecting part at a corresponding position of an inner frame edge for connecting with an end of each strip rail (1), ends of the two strip rails (1) are respectively connected (Continued)

to connecting parts of two frame pieces (2) to form a track body having a track surface with a middle portion hollowed, and a toy vehicle can locate left and right wheels on the left and right strip rails (1) exactly to run along the track. Based on a width of the toy vehicle, the frame pieces (2) with a corresponding width can be chosen to connect the strip rails (1), thus broadening the width of the tracks.

10 Claims, 7 Drawing Sheets

(56) References Cited

U.S. PATENT DOCUMENTS

| | | | | | |
|---|---|---|---|---|---|
| 3,645,035 | A * | 2/1972 | Fischer | A63H 18/02 | 446/102 |
| 3,712,539 | A * | 1/1973 | Staats | A63H 18/02 | 238/10 E |
| 4,080,742 | A * | 3/1978 | Osterried | A63H 19/30 | 33/561.2 |
| 5,681,201 | A * | 10/1997 | Choi | A63H 33/082 | 446/105 |
| 5,924,907 | A | 7/1999 | Tobin | | |
| 6,676,480 | B2 | 1/2004 | Sheltman | | |
| 2003/0224696 | A1 | 12/2003 | Sheltman | | |
| 2003/0224697 | A1 * | 12/2003 | Sheltman | A63H 18/00 | 446/444 |
| 2005/0287919 | A1 * | 12/2005 | Sheltman | A63H 18/028 | 446/444 |

FOREIGN PATENT DOCUMENTS

| | | | |
|---|---|---|---|
| CN | 203577321 | U | 5/2014 |
| CN | 103990287 | A | 8/2014 |
| CN | 203886187 | | 10/2014 |
| DE | 102005043658 | | 6/2006 |
| GB | 2068754 | | 8/1981 |
| JP | S52146398 | A | 12/1977 |
| JP | H01107798 | U | 7/1989 |
| JP | 2002166065 | A | 6/2002 |
| TW | 201204446 | | 2/2012 |
| WO | 2007081693 | | 7/2007 |

OTHER PUBLICATIONS

Office Action from EPO for EP Application No. 15792348 dated Nov. 24, 2017.

International Searching Authority, International Search Report for PCT/CN2015/078838 dated Aug. 17, 2015.

* cited by examiner

FREELY ASSEMBLABLE TOY TRACK

CROSS-REFERENCE TO RELATED APPLICATIONS

The present application is a national phase entry under 35 USC § 371 of International Application PCT/CN2015/078838, filed May 13, 2015, which claims the benefit of and priority to Chinese Patent Application No. 201410202455.1 filed May 14, 2014, the entire disclosure of which is incorporated herein by reference.

FIELD

The present invention relates to a toy track, and more particularly to a freely assemblable toy track.

BACKGROUND

A toy track has been popular for years. The earliest track is configured as an integral track body incapable of any changes, and a player can only play according to the way set by the manufacturer. Such toy track easily makes the player bored, and is disadvantageous to the improvement of his manual dexterity and development of his intelligence. Some existing toy tracks consist of a plurality of track segments, a front end and a rear end of each track segment are provided with a connecting structure for being spliced to another track segment, and the track segments are assembled into a path for running a toy vehicle via the connecting structure. However, such assembled toy track can only be assembled into a planar track body, but cannot be assembled into a three-dimensional track body, which results in less interestingness. Generally, the existing toy track includes a track surface for running the toy vehicle and a blocking edge for preventing the toy vehicle from leaving the track surface. Due to such design, material for the toy track sharply increases, and a cost of the toy is high. Further a width of the track surface is also limited by the track itself, thus toy vehicles having different sizes cannot run on the toy track.

SUMMARY

To solve the above-described problem existing in the related art, the object of the present invention is to provide a freely assemblable toy track with high cost effect, good applicability and high degree of freedom of assembling.

To attain the above object, the technical solution adopted by the present invention is that: A freely assemblable toy track, including a plurality of guide rails and connecting pieces. in which each guide rail includes two independent strip rails at the left and right, each connecting piece is configured as a frame piece provided with a connecting part at a corresponding position of an inner frame edge for connecting with an end of each strip rail, a front guide rail and a rear guide rail are connected through the frame piece to form a track body having a track surface with a middle portion hollowed.

The strip rail has an L-shaped section, and the frame piece is configured as a square frame body or a U-shaped frame body correspondingly.

Each connecting piece of the present invention may be configured as that: the connecting part of the frame piece is configured as grooves provided in two adjacent inner frame edges of an inner frame corner and two end portions of the strip rail are provided with raised lines protruding outwards and inserted into the grooves correspondingly; or the connecting part of the frame piece is configured as supporting plates protruding from two adjacent inner frame edges of an inner frame corner, and two supporting plates form a corner position where the strip rail is inserted together with the inner frame corner where the two supporting plates are located; or the connecting part of the frame piece is configured as blocking edges protruding and provided on two adjacent outer frame edges of an outer frame corner, each end portion of the strip rail is correspondingly provided with a corner inserting plate protruding outwards, the corner inserting plate has a size consistent with that of a corner position formed by the blocking edges and the outer frame corner, and an inner frame edge of the frame piece is flush with a track surface of the strip rail after the corner inserting plate is inserted into the corner position. Thus a toy vehicle can run on the track without influence. Besides the above designs of the connecting part, the connecting part may also be other connecting parts having the same function.

In order to more freely assemble and form tracks of different shapes, an outer frame edge of the frame piece is provide with a butt joint part configured as a half I-shaped insertion position.

When a double-track body or a multi-track body is needed, two above-described frame pieces are aligned with each other and combined to form an I-shaped insertion position, and the two frame pieces are butted to form the double-track body or the multi-track body by inserting an I-shaped inserting piece into the I-shaped insertion position.

The present invention further includes a supporting rod, the frame piece is provided with a connecting part at an outer frame edges for connecting with the supporting rod, and the supporting rod, the frame piece and the guide rails cooperate to assemble a three-dimensional track body.

In order to ensure that the connection is hard to disconnect, two end portions of the strip rail are provided with resilient snaps, and the connecting part of the frame piece is correspondingly provided with snap holes where the snap are snapped.

In the present invention, each guide rail includes two independent strip rails at the left and right, thereby reducing material of the track surface of the guide rail, reducing the manufacturing cost, and facilitate store. The connecting pieces are configured as the frame pieces which are provided with connecting parts at corresponding positions of inner frame edges for connecting with ends of the strip rails. Two ends of each of the two strip rails 1 at the left and right are connected to connecting parts of two frame pieces respectively to form a track body having a track surface with a middle portion hollowed, and a toy vehicle can locate its left and right wheels on the left and right strip rails exactly to run along the track. Based on a width of the toy vehicle, the frame pieces with a corresponding width are chosen to connect the strip rails, thus a width of the track is broadened and the scope of application of the toy track is effectively enlarged. Compared with an existing guide track which is assembled through front-back butt joint, the assembling of the toy track is harder and needs more skills, so a player can develop his manual dexterity and intelligence better. Since the frame piece is provided with a butt joint part on the outer frame edge, and the frame pieces can be butted and assembled through butt joint parts to form a double-track body or a multi-track body where multiple players can race. In addition, the supporting rod is provided, and the supporting rod is connected with the butt joint part of the frame piece to assemble a three-dimensional to track. Due to a high degree of freedom of assembling the toy track, players can fully exert imagination to assemble the track, so the toy track can motivate the players to develop their intelligence with lots of interestingness.

The present invention will be further described with reference to the following drawings and embodiments.

DETAILED DESCRIPTION

Figure 1:
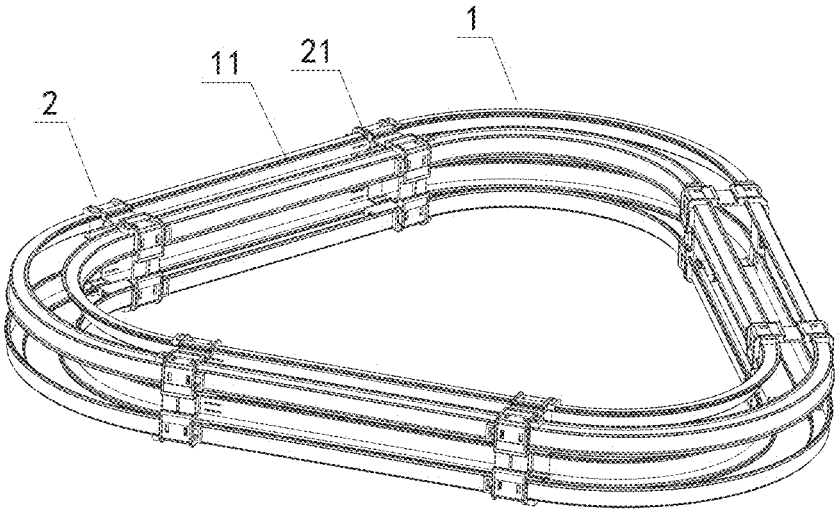
FIG. 1 is a perspective view of a plane toy track of the present invention.
Figure 2:
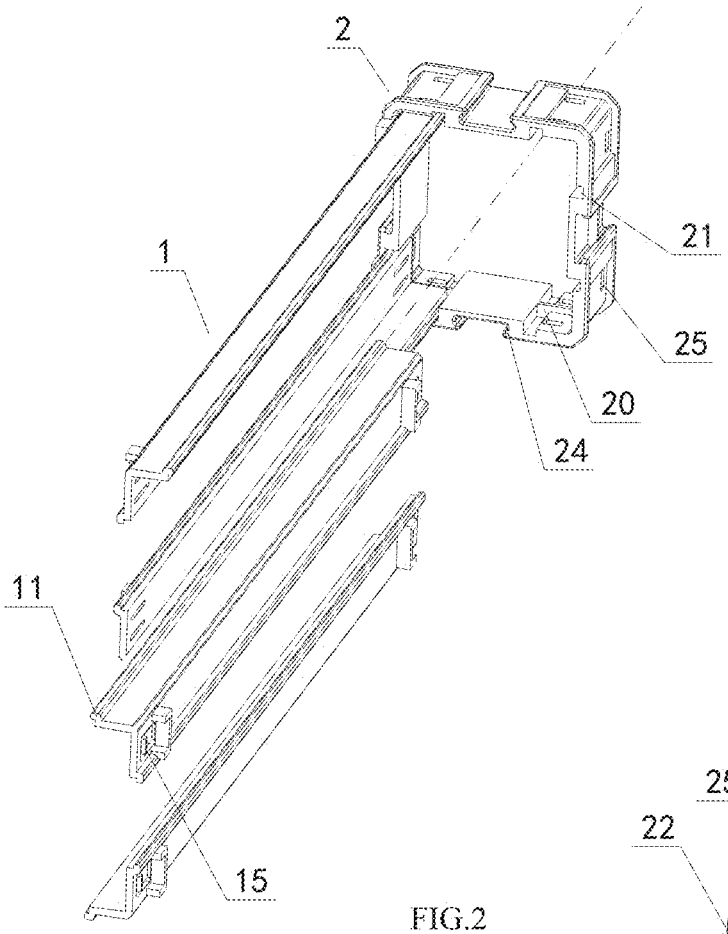
FIG. 2 is a schematic view of a connection status of a frame piece in a first shape and a strip rail of the present invention.

As shown in FIGS. 1 and 2, a freely assemblable toy track according to the present invention includes a plurality of guide rails and connecting pieces, each guide rail includes two independent strip rails (1) at the left and right, and each connecting piece is configured as a frame piece 2. The frame piece 2 is provided with connecting parts at a corresponding position of an inner frame edge for connecting with an end of each strip rail 1. Two ends of each of the two strip rails 1 at the left and right are respectively connected to connecting parts of two frame pieces 2 to form a track body having a track surface with a middle portion hollowed, and a toy vehicle can locate its left and right wheels on the left and right strip rails 1 exactly to run along the track. Based on a width of the toy vehicle, the frame pieces 2 with a corresponding width can be chosen to connect the strip rails 1, thus a width of the track is broadened and the scope of application of the toy track is effectively enlarged. Compared with an existing guide track which is assembled through front-back butt joint, the assembling of the toy track is harder and needs more skills, so a player can develop his manual dexterity and intelligence better.

Figure 3:
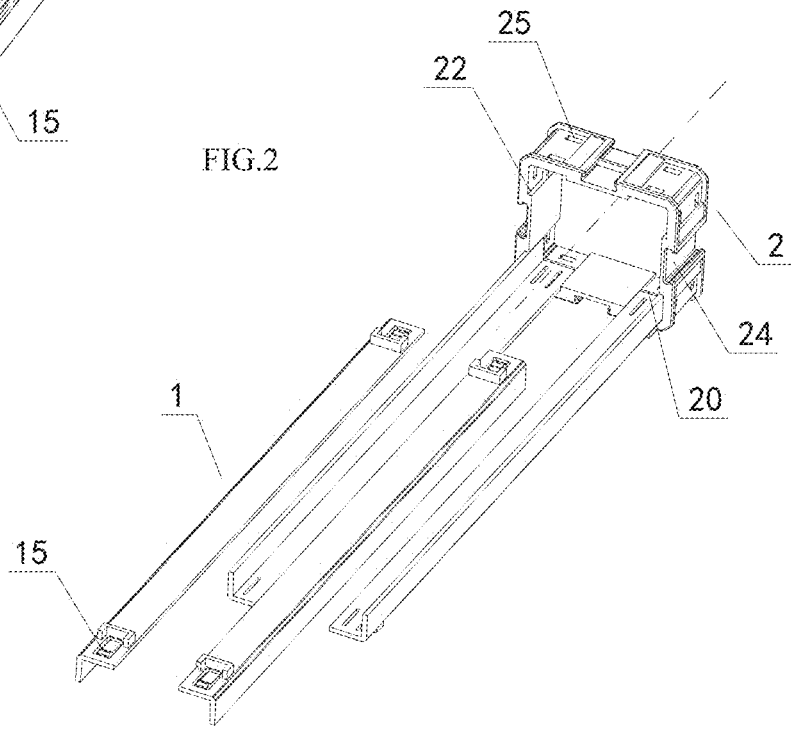
FIG. 3 is a schematic view of a connection status of a frame piece in a second shape and a strip rail of the present invention.
Figure 4:
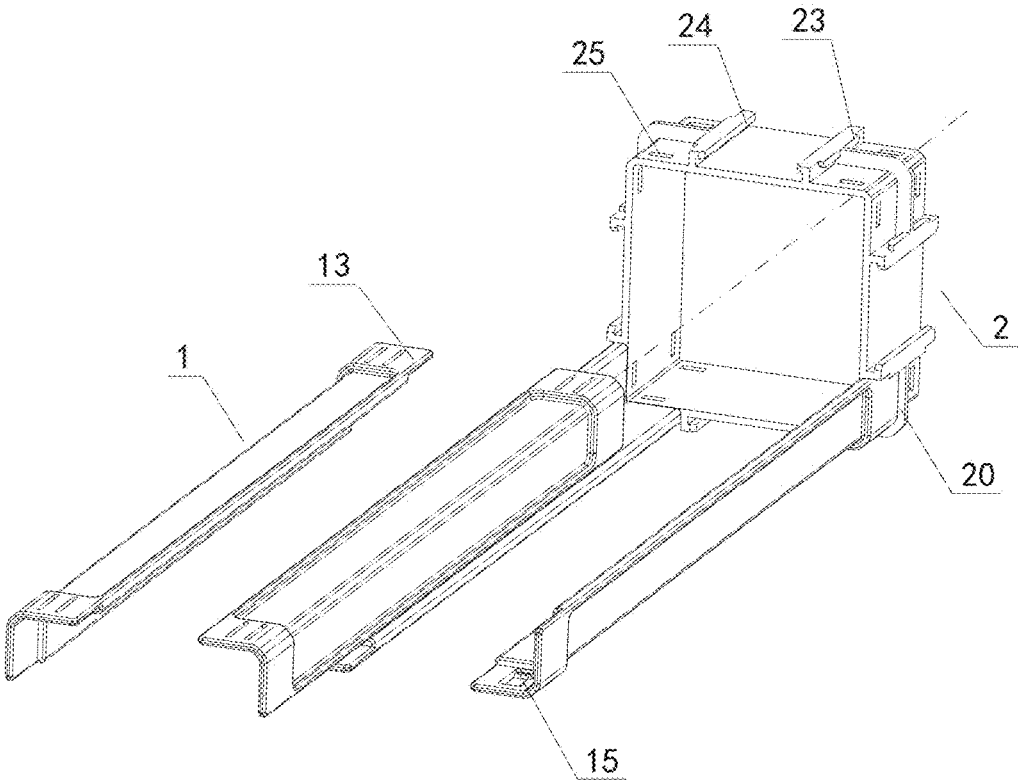
FIG. 4 is a schematic view of a connection status of a frame piece in a third shape and a strip rail of the present invention.
Figure 5:
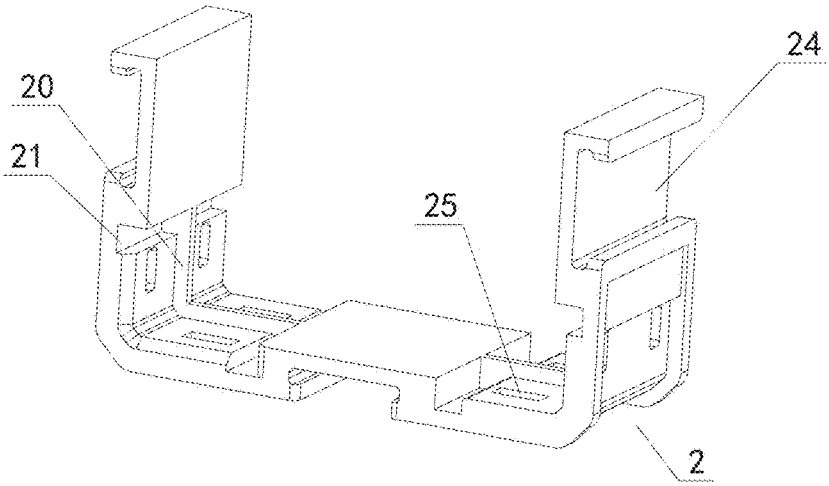
FIG. 5 is a perspective view of a frame piece in a fourth shape of the present invention.
Figure 6:
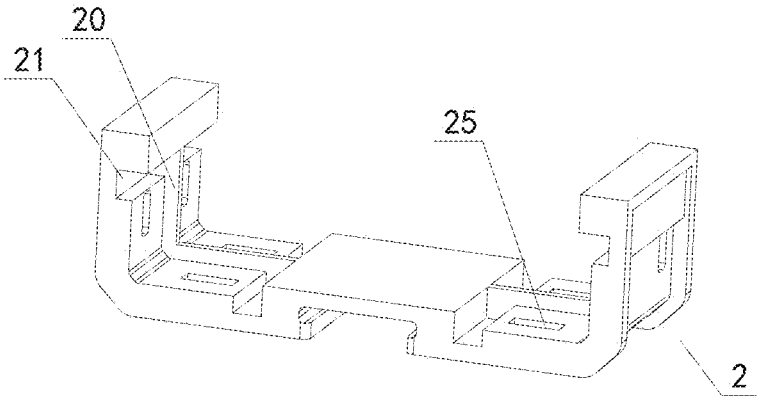
FIG. 6 is a perspective view of a frame piece in a fifth shape of the present invention.
Figure 7:
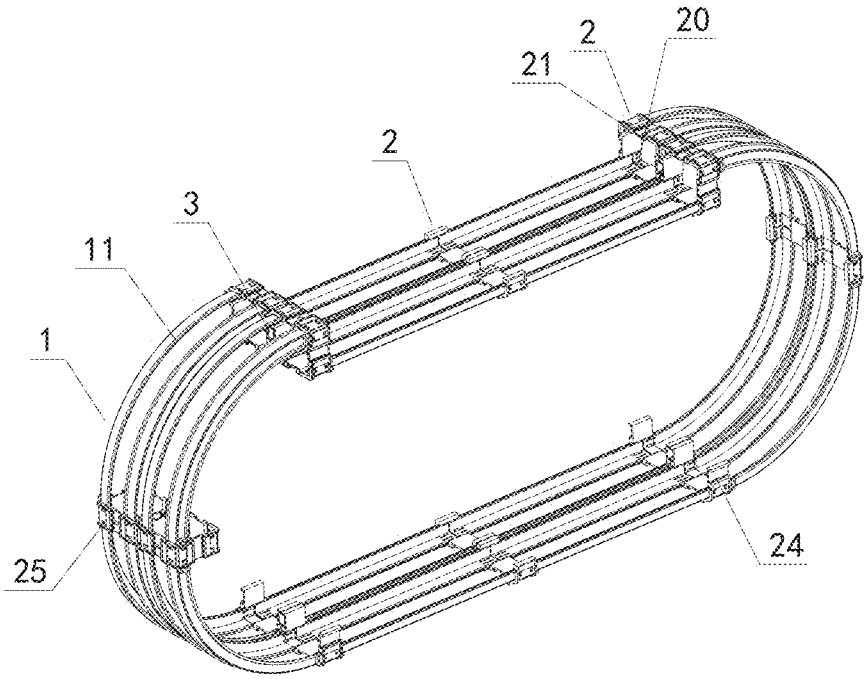
FIG. 7 is a perspective view of a toy track with a blend of frame pieces in a plurality of shapes of the present invention.

As shown in FIG. 2, the strip rail 1 of the present embodiment is substantially L-shaped, each strip rail has a horizontal edge for contacting wheels of the toy vehicle and a vertical edge serving as a blocking edge to prevent the toy vehicle running on the track from leaving the track. The frame piece 2 of embodiments may have a plurality of designs. As shown in FIG. 2, the frame piece 2 is configured as a square frame body, the connecting part of the frame piece 2 is configured as grooves 21 provided in two adjacent inner frame edges of an inner frame corner, and distances from two grooves 21 to the inner frame corner are consistent with lengths of two edges of the L-shaped strip rail 1 respectively. Two end portions of the strip rail 1 are provided with two raised lines 11 protruding outwards and inserted into the two grooves 21 correspondingly. All the four inner frame corners of the frame piece 2 are provided with the connecting parts, so that four strip rails 1 can be mounted to the frame piece 2 to form an upper guide rail and a lower guide rail which are suitable for running a double sided toy vehicle. As shown in FIG. 3, the frame piece 2 is configured as a square frame body, the connecting part of the frame piece 2 is configured as supporting plates 22 protruding from two adjacent inner frame edges of the inner frame corner, and two supporting plates 22 form a corner position where the strip rail 1 is inserted together with the inner frame corner where the two supporting plates 22 are located. When the strip rail 1 is inserted into a position between the two supporting plates 22, two edge surfaces of the strip rail 1 are in surface contact with the two supporting plates 22, and then the strip rail 1 is fixed. All of the four inner frame corners of the frame piece 2 are provided with the connecting parts, so that four strip rails 1 can be mounted to the frame piece 2. As shown in FIG. 4, the frame piece 2 is configured as a square frame body, and the connecting part of the frame piece 2 is configured as blocking edges 23 protruding and provided on two adjacent outer frame edges of an outer frame corner. Each end of the strip rail 1 is correspondingly provided with a corner inserting plate 13 protruding outwards, and the corner inserting plate has a size consistent with that of a corner position formed by the blocking edges 23 and the outer frame corner. An inner frame edge of the frame piece 2 is flush with the track surface of the strip rail 1 after the corner inserting plate 13 is inserted in the corner position, so that the toy vehicle can run on the track without influence. All of four outer frame corners of the frame piece 2 are provided with the connecting parts, so that four strip rails 1 can be mounted to the frame piece 2. As shown in FIG. 5, the frame piece 2 is configured as a U-shaped frame body, and the U-shaped frame piece 2 is larger than a half of the frame piece 2 shown in FIG. 2, that is, two vertical edges of the frame piece 2 are longer. The connecting part of the frame piece 2 is configured as the grooves 21 which are the same as the connecting parts of the frame piece 2 shown in FIG. 2, and distances from the two grooves 21 to an inner frame corner are consistent with the lengths of the two edges of the L-shaped strip rail 1 respectively. The two end portions of the strip rail 1 are provided with two raised lines protruding outwards and inserted into the two grooves 21 correspondingly. The frame piece 2 can be provided with only two connecting parts, only two strip rails 1 can be mounted to the frame piece, so the frame piece can be used to connect to the upper guide rail or the lower guide rail. As shown in FIG. 6, the frame piece 2 is configured as a U-shaped frame body, and the U-shaped frame piece 2 is smaller than a half of the frame piece 2 shown in FIG. 2, that is, two vertical edges of the frame piece 2 is shorter. The connecting part of the frame piece 2 is configured as grooves 21 which are the same as the connecting parts of the frame piece 2 shown in FIG. 2. Distances from the two grooves 21 to an inner frame corner are consistent with the lengths of the two edges of the L-shaped strip rail 1 respectively. The two end portions of the strip rail 1 are provided with two raised lines protruding outwards and inserted into the two grooves 21 correspondingly. The frame piece 2 can be provided with only two connecting parts and, only two strip rails 1, can be mounted to the frame piece, so the frame piece can be used to connect to the upper guide rail or the lower guide rail. As to the U-shaped frame pieces 2 shown in FIGS. 5 and 6, the connecting parts thereof are not limit to be the same as the connecting parts shown in FIG. 2, the connecting parts may also be the same as the connecting parts shown in FIG. 3 or 4, or other connecting parts capable of connecting and fixing the strip rail 1. The above five kinds of frame pieces are not limit to be used individually, but frame pieces of different kinds may be used cooperatively. A toy track shown in FIG. 7 is assembled with the strip rails 1 and the three kinds of frame pieces shown in FIGS. 2, 5 and 6 which are used cooperatively. The connecting part at the same corner of any one of the five kinds of frame pieces above is separated by a separating plate 20 to form a front connecting part and a rear connecting part, a front segment guide rail and a rear segment guide rail are connected to the front connecting part and the rear connecting part of the frame piece 2 respectively to assemble a track body. In addition, in order to ensure that the connection is hard to disconnect, two end portions of the strip rail 1 are provided with resilient snaps 15, and the connecting part of the frame piece 2 is correspondingly provided with snap holes 25 where the snaps 15 are snapped. Each elastic snap 15 of the present embodiment is configured as that: a rectangular hole is provided in a blocking edge surface of the strip rail 1, a resilient convex key is disposed in the rectangular hole. A front end and a rear end of the resilient convex key extend to end surfaces of the rectangular hole, and clearances are provided between two side surfaces of the resilient convex key and two side surfaces of the rectangle hole. A front-rear extending direction of the resilient convex key is consistent with a length direction of the strip rail 1, while an existing resilient snap 15 is generally configured as that: only a rear end of the resilient convex key extends to an end surface of a rectangular hole, so that the above-designed resilient snap 15 is more durable and has a longer service life than the existing resilient snap which either breaks easily or loses the resiliently thereof after long-term usage. The strip rail 1 of the present invention includes a straight strip rail 1 and a quadrant arc strip rail 1.

As shown in FIGS. 2 to 5, an outer frame edge of the frame piece 2 is provided with a butt joint part configured as a half I-shaped insertion position 24. The U-shaped frame piece 2 shown in FIG. 6 is not provided with a butt joint part, it is mainly because the vertical edges of the frame piece 2 shown in FIG. 6 is short, the frame piece 2 shown in FIG. 6 does not has a function of butt joint. With the butt joint part, a double-track body, a multi-track body or a three-dimensional track body are available.

Figure 8:
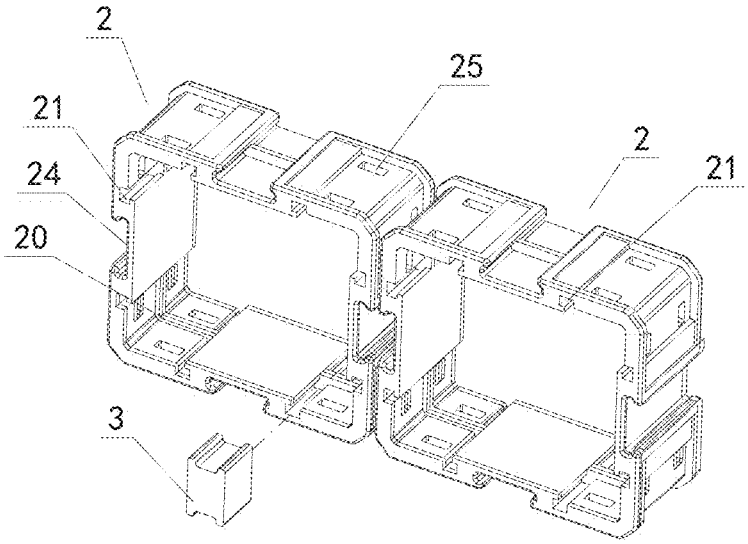
FIG. 8 is a perspective view of a splicing status of two frame pieces of the present invention.

When the double-track body or the multi-track body is needed, two above-described frame pieces 2 are aligned with each other and combined to form an I-shaped insertion position, and the two frame pieces 2 are positioned side by side by inserting an I-shaped inserting piece 3 into the insertion position, which is shown in FIG. 8. Therefore, each two frame pieces 2 are butted, and then the strip rails 1 are assembled thereon to form the double-track body or the multi-track body. A toy vehicle track shown in FIG. 7 is a double-track body on which two players can race toy vehicles.

Figure 9:
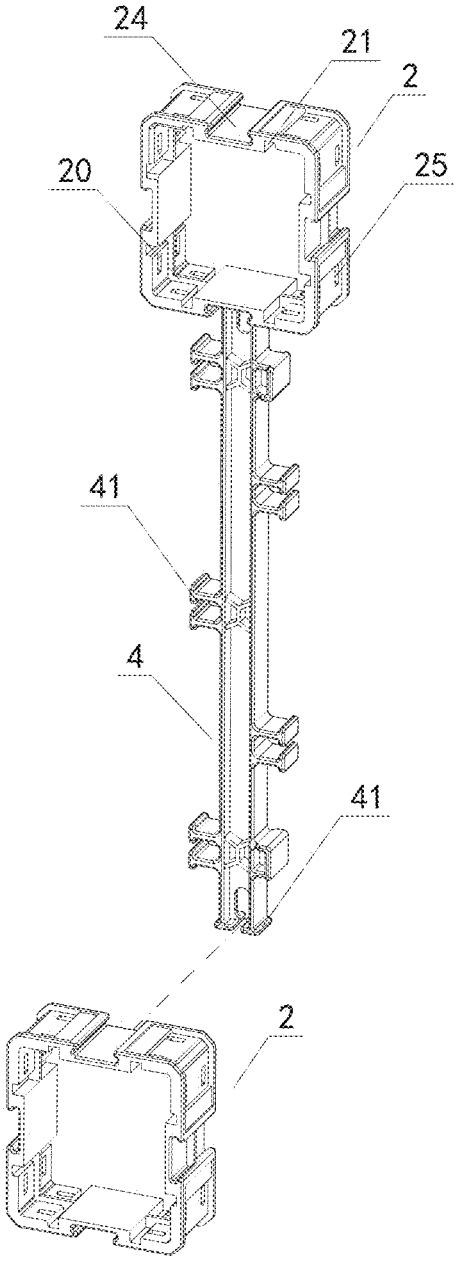
FIG. 9 is a schematic view of a connection status of a supporting rod and a frame piece of the present invention.
Figure 10:
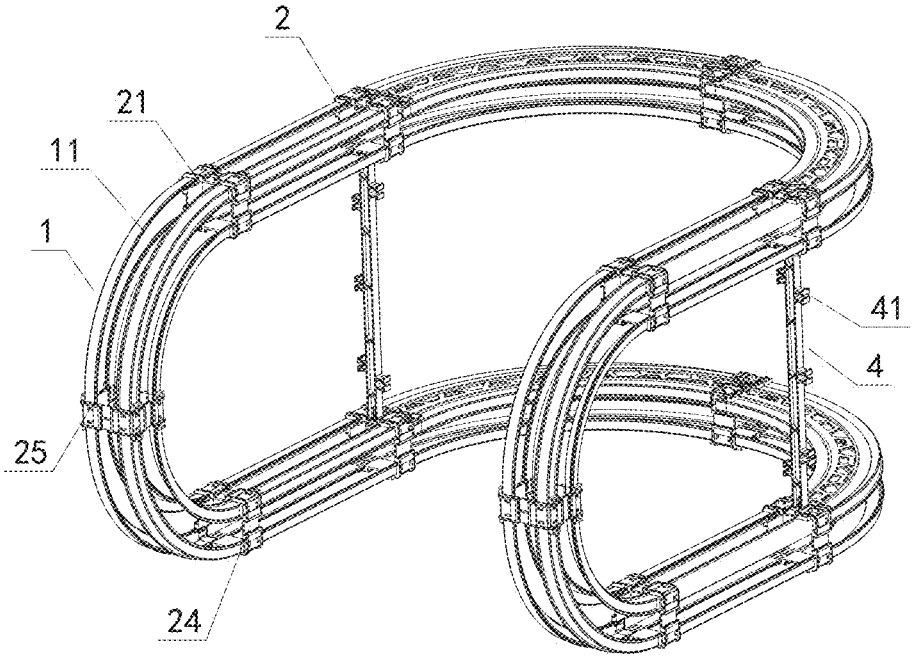
FIG. 10 is a perspective view of a three-dimensional toy track of the present invention.

As shown in FIGS. 9 and 10, the present invention further includes a supporting rod 4. The frame piece 2 is provided with a connecting part at an outer frame edge, and the connecting part is used for connecting with the supporting rod 4 and configured as a half I-shaped insertion position 24, that is, the butt joint part of the frame piece 2 can also serve as the connecting part for connecting with the supporting rod 4. Meanwhile, two ends and a rod body of the supporting rod 4 are respectively provided with a II-shaped inserting pin 41 fined with the half I-shaped insertion position 24 through insertion, and each II-shaped inserting pin 41 can be connected to a half of the insertion position 24 of the frame piece 2. Therefore, toy tracks of various three-dimensional shapes can be assembled through the supporting rod 4, and besides a three-dimensional toy track shown in FIG. 10, a spiral three-dimensional toy track, a Ferris wheel three-dimensional toy track and so on can be assembled. Players can put their imagination and manual dexterity to fully use, so the toy track can motivate the players to develop their intelligence with lots of interestingness. Besides, interesting toy tracks of more shapes can also be assembled by cooperating with other fittings.

Although the present invention is described according to specific embodiments, but it cannot construed to limit the present invention. Other changes of the disclosed embodiments can be expected by those skilled in the art with reference to the description, and these changes are within the scope of the appended claims.

What is claimed is:

1. A freely assemblable toy track, comprising a plurality of guide rails and connecting pieces, wherein each guide rail comprises two independent strip rails (1) at the left and right, each connecting piece is configured as a frame piece (2) provided with a connecting part at a corresponding position of an inner frame edge for connecting with an end of each strip rail (1), a front guide rail and a rear guide rail are connected through the frame piece (2) to form a track body having a track surface with a middle portion hollowed, wherein the strip rail (1) has an L-shaped section, and the frame piece (2) is configured as a square frame body or a U-shaped frame body correspondingly, and wherein the connecting part of the frame piece (2) is configured as grooves (21) provided in two adjacent inner frame edges of an inner frame corner, and two end portions of the strip rail (1) are provided with raised lines (11) protruding outwards and inserted into the grooves (21) correspondingly.

2. The freely assemblable toy track according to claim 1, wherein the connecting part of the frame piece (2) is configured as supporting plates (22) protruding from two adjacent inner frame edges of an inner frame corner, and two supporting plates (22) form a corner position where the strip rail (1) is inserted together with the inner frame corner where the two supporting plates (22) are located.

3. The freely assemblable toy track according to claim 1, wherein the connecting part of the frame piece (2) is configured as blocking edges (23) protruding and provided on two adjacent outer frame edges of an outer frame corner, each end portion of the strip rail (1) is correspondingly provided with a corner inserting plate (13) protruding outwards, the corner inserting plate has a size consistent with that of a corner position formed by the blocking edges (23) and the outer frame corner, and an inner frame edge of the frame piece (2) is flush with a track surface of the strip rail (1) after the corner inserting plate (13) is inserted into the corner position.

4. The freely assemblable toy track according to claim 1, wherein an outer frame edge of the frame piece (2) is provided with a butt joint part configured as a half I-shaped insertion position (24).

5. The freely assemblable toy track according to claim 4, wherein two frame pieces (2) are aligned with each other and combined to form an I-shaped insertion position, and the two frame pieces (2) are butted to form a double-track body or a multi-track body by inserting an I-shaped inserting piece (3) into the I-shaped insertion position.

6. The freely assemblable toy track according to claim 1, further comprising a supporting rod (4), wherein the frame piece (2) is provided with a connecting part at an outer frame edge for connecting with the supporting rod (4), and the supporting rod (4), the frame piece (2) and the guide rails cooperate to assemble a three-dimensional track body.

7. The freely assemblable toy track according to claim 6, wherein the connecting part of the frame piece (2) is configured as a half I-shaped insertion position (24), and two ends and/or a rod body of the supporting rod (4) are provided with II-shaped inserting pins (41) fitted with the half I-shaped insertion position (24) in through insertion.

8. The freely assemblable toy track according to claim 1, wherein two end portions of the strip rail (1) are provided with resilient snaps (15), and the connecting part of the frame piece (2) is correspondingly provided with snap holes (25) where the snap (15) are snapped.

9. A freely assemblable toy track, comprising a plurality of guide rails and connecting pieces, wherein each guide rail comprises two independent strip rails (1) at the left and right, each connecting piece is configured as a frame piece (2) provided with a connecting part at a corresponding position of an inner frame edge for connecting with an end of each strip rail (1), a front guide rail and a rear guide rail are connected through the frame piece (2) to form a track body having a track surface with a middle portion hollowed, wherein the strip rail (1) has an L-shaped section, and the frame piece (2) is configured as a square frame body or a U-shaped frame body correspondingly, and wherein the connecting part of the frame piece (2) is configured as blocking edges (23) protruding and provided on two adjacent outer frame edges of an outer frame corner, each end portion of the strip rail (1) is correspondingly provided with a corner inserting plate (13) protruding outwards, the corner inserting plate has a size consistent with that of a corner position formed by the blocking edges (23) and the outer frame corner, and an inner frame edge of the frame piece (2) is flush with a track surface of the strip rail (1) after the corner inserting plate (13) is inserted into the corner position.

10. A freely assemblable toy track, comprising a plurality of guide rails and connecting pieces, wherein each guide rail comprises two independent strip rails (1) at the left and right, each connecting piece is configured as a frame piece (2) provided with a connecting part at a corresponding position of an inner frame edge for connecting with an end of each strip rail (1), a front guide rail and a rear guide rail are connected through the frame piece (2) to form a track body having a track surface with a middle portion hollowed, wherein an outer frame edge of the frame piece (2) is provided with a butt joint part configured as a half I-shaped insertion position (24), and wherein two frame pieces (2) are aligned with each other and combined to form an I-shaped insertion position, and the two frame pieces (2) are butted to form a double-track body or a multi-track body by inserting an I-shaped inserting piece (3) into the I-shaped insertion position.

* * * * *